United States Patent [19]

Strandli

[11] 3,980,020

[45] Sept. 14, 1976

[54] PROJECTILE WITH DELAYED BURSTING EFFECT

[75] Inventor: Kåre Roald Strandli, Raufoss, Norway

[73] Assignee: A/S Raufoss Ammunisjonsfabrikker, Raufoss, Norway

[22] Filed: May 17, 1974

[21] Appl. No.: 471,153

[30] Foreign Application Priority Data

May 18, 1973 Norway ..... 2068/73

[52] U.S. Cl. ..... 102/66; 102/73 R

[51] Int. Cl.[2] ..... F42B 13/14

[58] Field of Search ..... 102/52, 56, 66, 73

[56] References Cited

UNITED STATES PATENTS

| | | | |
|---|---|---|---|
| 2,217,645 | 10/1940 | De Wilde et al. | 102/66 |
| 3,370,536 | 2/1968 | Francis et al. | 102/66 |
| 3,677,181 | 7/1972 | Giljarhus et al. | 102/66 |

*Primary Examiner*—Verlin R. Pendegrass

*Attorney, Agent, or Firm*—Larson, Taylor and Hinds

[57] ABSTRACT

A projectile having at least one incendiary charge ahead of a main bursting charge and adapted to ignite the same. An adjustment charge forward of the incendiary charge is ignited upon impact of the projectile for driving a body rearwardly into the incendiary charge to form an elongated aperture upon ignition of the incendiary charge.

5 Claims, 2 Drawing Figures

PROJECTILE WITH DELAYED BURSTING EFFECT

Figure 1:
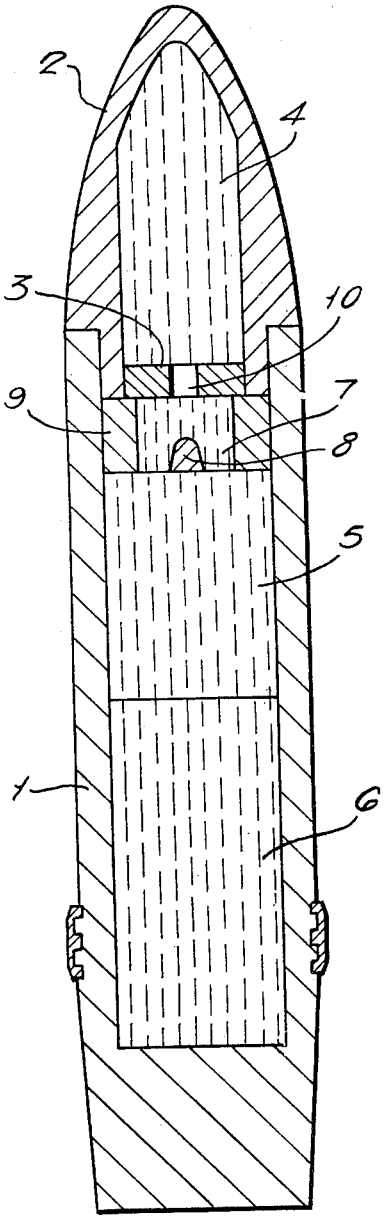

The present invention relates to a projectile having delayed bursting effect, i.e. a projectile containing at least one bursting charge which is ignited with a certain delay in relation to the impinge of the projectile against a target. A known principle to obtain such a delay is to arrange at least one incendiary charge before the bursting charge in the projectile and to utilize the relatively low rate of combustion of the burning mass to obtain delayed bursting, said incendiary charge or charges being ignited at or immediately after the impingement against the target, either ny means of an incendiary charge in the nose of the projectile or by the use of a fuse, resp. in combination with one or more safety devices.

The present invention concerns especially the problem of obtaining desired delay of the pyrotechnical chain at the reaction of one or more incendiary charges which are arranged before at least one bursting charge.

A known method of obtaining such a desired delay is to adapt the composition, the compression and the dimensions of incendiary charge (—s) so that the desireable delay is obtained.

By adjusting the compositon and compression of the incendiary mass the rate of combustion can be adjusted, and by adapting the length of the charge (—s) the time of burning-through at a certain rate of combustion can be adjusted. This way of adjusting the delay especially has the disadvantage that the incendiary charge (—s) located before the bursting charge in many cases will have to be made smaller than desireable to obtain a sufficiently short delay. Thereby the projectile will get reduced incendiary effect, which obviously often is undesired.

The above mentioned drawbacks are eliminated according to the invention as described below.

The adjustment-charge must be so adapted that it provides a suitable aperture in the incendiary charge. Further, the charge body or bodies which are incorporated in the total charge, must be so adapted as to dimensions, form, mass and hardness that a desired delay is obtained. Said aperture causes the combustion of the charge to start at some distance into it, the ignition being occasioned by the flame from the adjustment charge or from the charge located in front thereof. Thereby the time of burning through the charge is reduced. The aperture further has the effect that the charge is ignited over a relatively large surface, i.e. the walls of the aperture. This results in increased intensity of the combustion of the charge and makes for a greater safety as to the ignition of the charges located rearwardly thereof. A less sensitive bursting charge thereby also can be used, whereby the handling safety of the projectile is enhanced.

According to the invention desired delay thus can be obtained for the ignition of a bursting charge which is located behind an incendiary charge in a projectile without influencing the size of the incendiary charge.

The invention will be further described below in connection with embodiments shown in the drawings in FIGS. 1 and 2.

Figure 2:
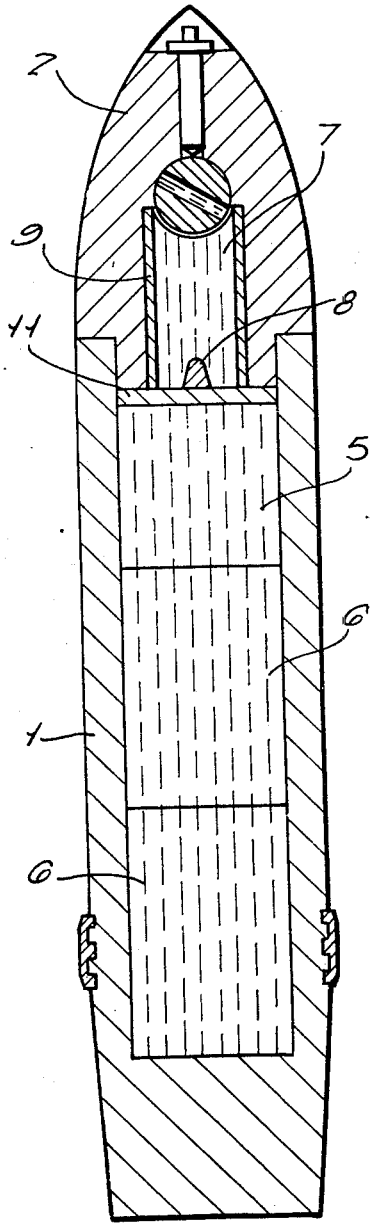

The projectile of FIG. 1 is substantially built up from known per se parts, i.e. a main projectile body 1, preferably of steel, and a nose or casing 2 which can be of a soft material and which contains an incendiary charge

4 intended to be ignited by impinging a target. Such incendiary charge is usually supported by a disc 3 having a through-going hole 10 and serving to prevent set-back of the charge 4 at the firing moment. In the nose 2 a fuse can also be arranged instead of the incendiary charge 4.

The projectile further contains an incendiary charge 5 and at least one bursting charge 6.

For the formation of at least one aperture in the incendiary charge 5 there is arranged an adjustment charge 7 and at least one body 8 in front of the incendiary charge 5 i.e., at the rear boundary of the adjustment charge 7. When using a fuse in the nose, as shown in FIG. 2, a detonator in the fuse can be located in for instance the bore of a rotating safety device, which detonator ignites the adjustment charge. An adjustment charge can alternatively be formed by the detonator of the safety device. The adjustment charge can also be enclosed by a mantle 9.

It is immaterial what means is used for the ignition of the adjustment charge. The nose of the projectile with its ignition mechanism can thus be formed in various ways. The essential point is that the adjustment charge 7 is ignited by the impinging against a target and that it throws at least one body 8 into the incendiary charge 5 located rearwardly thereof.

The body 8 can be formed in various ways and can preferably, but not necessarily, be made from steel.

Behind the body 8 may be inserted a plate 11 to hold the body 8 in place during mounting transport and firing.

I claim:

1. An elongated projectile of the type wherein the bursting effect is delayed following impingement of the front of the projectile against a target, comprising:

a bursting charge, an incendiary charge arranged in front of the bursting charge, said incendiary charge being capable of burning, upon ignition thereof, until it ignites the bursting charge, an adjustment charge arranged in front of the said incendiary charge so as to ignite said incendiary charge, a body arranged at the rear boundary of said adjustment charge and capable of being driven rearwardly into the incendiary charge, upon ignition of the adjustment charge, to form a longitudinal aperture into the incendiary charge, and means for igniting the adjustment charge upon impingement of the forward end of the projectile against a target.

2. A projectile according to claim 1, said means for igniting the adjustment charge comprising a fuse located forwardly of the adjustment charge, a rotatable safety device located between the fuse and the adjustment charge and including a bore adapted to align the fuse with the adjustment charge when the projectile is in flight, and including a detonator material in the said bore.

3. A projectile according to claim 1, wherein said means for igniting the adjustment charge includes a fuse located forwardly of the adjustment charge, a rotatable safety device located between the adjustment charge and the fuse and including a bore therethrough adapted to align the fuse with the adjustment charge when the projectile is in flight, and wherein a portion of the adjustment charge is located in said bore.

4. A projectile according to claim 1, wherein said means for igniting the adjustment charge comprises an incendiary charge located forwardly of the adjustment charge within a casing formed of a relatively soft material, and including a disc having an opening therethrough arranged between the forwardmost incendiary charge and the adjustment charge to prevent premature rearward movement of the said forwardmost incendiary charge.

5. A projectile according to claim 1, including a plate located rearwardly of the said body and forwardly of the incendiary charge.

* * * * *